US006857399B2

(12) United States Patent
Davis et al.

(10) Patent No.: US 6,857,399 B2
(45) Date of Patent: Feb. 22, 2005

(54) AIR CLEANER ASSEMBLY FOR INTERNAL COMBUSTION ENGINES

(75) Inventors: Steven T. Davis, Green Bay, WI (US); Dale D. Snyder, Neenah, WI (US); Bill Wollersheim, Plymouth, WI (US)

(73) Assignee: Tecumseh Products Company, Tecumseh, MI (US)

( * ) Notice: Subject to any disclaimer, the term of this patent is extended or adjusted under 35 U.S.C. 154(b) by 78 days.

(21) Appl. No.: 10/408,882

(22) Filed: Apr. 8, 2003

(65) Prior Publication Data

US 2004/0025810 A1 Feb. 12, 2004

Related U.S. Application Data

(60) Provisional application No. 60/402,841, filed on Aug. 12, 2002.

(51) Int. Cl.[7] ..... F01P 1/02

(52) U.S. Cl. ..... 123/41.7; 123/198 E

(58) Field of Search ..... 123/41.56–41.7, 123/2, 195 C, 198 E

(56) References Cited

U.S. PATENT DOCUMENTS

| | | | | |
|---|---|---|---|---|
| 2,920,717 A | | 1/1960 | Tuttle et al. | 183/44 |
| 3,218,785 A | | 11/1965 | Tietz | 55/503 |
| 4,658,767 A | | 4/1987 | Fujikawa et al. | 123/52 MV |
| 4,871,455 A | | 10/1989 | Terhune et al. | 210/232 |
| 4,915,831 A | | 4/1990 | Taylor | 210/232 |
| 5,035,586 A | * | 7/1991 | Sadler et al. | 417/363 |
| 5,045,192 A | | 9/1991 | Terhune | 210/232 |
| 5,227,074 A | | 7/1993 | Nichols et al. | 210/767 |
| 5,474,679 A | | 12/1995 | Nichols et al. | 210/477 |
| 5,503,649 A | | 4/1996 | Nickel | 55/321 |
| 5,736,043 A | | 4/1998 | Nichols et al. | 210/477 |
| 5,813,384 A | | 9/1998 | Lavender et al. | 123/198 E |
| 6,178,939 B1 | * | 1/2001 | Powell | 123/184.21 |
| 6,355,077 B1 | | 3/2002 | Chittenden et al. | 55/383.5 |
| 6,398,838 B1 | | 6/2002 | Kaffenberger | 55/498 |
| 6,402,798 B1 | | 6/2002 | Kallsen et al. | 55/383.5 |
| 6,419,718 B1 | | 7/2002 | Klug et al. | 55/320 |
| 6,474,290 B1 | | 11/2002 | Coffey et al. | 123/198 E |
| 2002/0009372 A1 | | 1/2002 | Gruber et al. | 417/234 |

FOREIGN PATENT DOCUMENTS

| | | | | |
|---|---|---|---|---|
| EP | 0 318 059 | | 5/1989 | |
| EP | 1 092 852 | | 4/2001 | |
| JP | 61081571 A | * | 4/1986 | F02M/35/06 |
| JP | 11-062733 | | 3/1999 | |
| JP | 2002-070667 | | 3/2002 | |

* cited by examiner

*Primary Examiner*—Noah P. Kamen
(74) *Attorney, Agent, or Firm*—Baker & Daniels

(57) ABSTRACT

An air cleaner for small internal combustion engines, including a removable or replaceable air cleaner element detachably mounted within an air cleaner cavity which is defined at least on part by the shroud of the engine. The air cleaner element includes engagement structure for releasable engagement with a wall of the air cleaner cavity to permit mounting of the sir cleaner element within the cavity, and removal of the air cleaner element from the cavity, without the use of tools. In addition, a cover is provided for releasably engaging the air cleaner cavity to cover the air cleaner element.

15 Claims, 4 Drawing Sheets

AIR CLEANER ASSEMBLY FOR INTERNAL COMBUSTION ENGINES

CROSS REFERENCE TO RELATED APPLICATIONS

This application claims the benefit under Title 35, U.S.C. § 119(e) of U.S. Provisional Patent Application Ser. No. 60/402,841, entitled INTERNAL COMBUSTION ENGINE, filed on Aug. 12, 2002.

BACKGROUND OF THE, INVENTION

1. Field of the Invention

The present invention relates to small internal combustion engines of the type used with lawnmowers, lawn tractors, other small working implements, or sport vehicles, for example. In particular, the present invention relates to an air cleaner assembly for such engines.

2. Description of the Related Art

Intake systems of small internal combustion engines provide an air/fuel mixture for combustion with the combustion chamber(s) of the engines to drive the engines. Typically, such intake systems include either a carburetor or a fuel injector for mixing air with fuel to provide the air/fuel mixture. Further, the intake system includes an air cleaner assembly for separating particulate matter such as dust, dirt, or other debris from the intake air before the intake air is drawn into the carburetor for mixing with fuel.

Typically, the air cleaner assembly includes an air cleaner housing in the form of a separate component attached to the engine or blower housing of the engine by suitable brackets, fasteners, etc. The air cleaner housing contains a filter element made of a fibrous material, or screen made of a mesh material, which permits the intake air to pass therethrough, yet which traps particulate matter which could be harmful to the engine if same were allowed to pass with the intake air into the carburetor.

One problem with known air cleaner assemblies is that the air cleaner housing is usually not positioned on the engine in a manner in which it is easily accessible for maintenance, such as changing the filter element when same becomes clogged with particulate matter. For example, the air cleaner housing may be located on a portion of the engine which is difficult for a user to access. Further, when the air cleaner housing is attached to the engine using brackets, fasteners, etc., failure of the attachment assembly may result during the operational life of the engine.

Also, known air cleaner housings usually include a cover which is difficult to remove for access to the air filter element. Often, the cover is attached to the air cleaner housing with a plurality of fasteners, such that tools are required to remove the cover from the air cleaner housing.

Further, if the cover of known air cleaner housings is too easily removable, same may become detached from the air cleaner body during operation of the engine. In this manner, the filter element may become dislodged from, or even fall out of, the air cleaner housing during running of the engine, reducing or eliminating the filtering of particulate matter from the intake air drawn into the carburetor and the engine.

Finally, the air cleaner housing is typically a bulky component which takes up a large amount of space around the engine, which space is at a premium in small internal combustion engines.

What is needed is an air cleaner assembly for a small internal combustion engines which is an improvement over the foregoing.

SUMMARY OF THE INVENTION

The present invention provides an air cleaner system for small internal combustion engines, including a removable or replaceable air cleaner element detachably mounted within an air cleaner cavity which is defined at least in part by the shroud of the engine. The air cleaner element includes engagement structure for releasable engagement with a wall of the air cleaner cavity to permit mounting of the air cleaner element within the cavity, and removal of the air cleaner element from the cavity, without the use of tools. In addition, a cover is provided for releasably engaging the air cleaner cavity to cover the air cleaner element.

In one embodiment, an engine is provided including a shroud which covers at least a portion of the engine crankcase and engine cylinder(s), as well as the flywheel of the engine. The shroud includes an upper front portion having a recessed portion which at least partially defines therein the air cleaner cavity. The recessed portion is in communication with the intake end of the engine carburetor. A cover is removably attached to the shroud to define the air cleaner cavity therebetween. The air cleaner cavity includes a plurality of mounts for releasable receipt of a corresponding plurality of tabs on the air cleaner element to releasably attach the air cleaner element to the base wall of the air cleaner cavity and to position the air cleaner element centrally within the air cleaner cavity about the intake end of the carburetor.

Advantageously, the present arrangement allows for installation of the air cleaner element within the air cleaner cavity, and removal of the air cleaner element from the air cleaner cavity for cleaning and/or replacement, without the use of tools. Additionally, because the air cleaner element is fixedly attached within the air cleaner cavity, the air cleaner element remains in position to filter dirt, dust, or other debris from the intake air even if the cover should fall off or be removed from the shroud.

Further, because the air cleaner cavity is defined with a recessed portion of the shroud, the present air cleaner assembly does not include an air cleaner housing which is separate from the shroud, thereby eliminating the need for brackets, fasteners, etc., which would otherwise be needed to attach a separate air cleaner housing to the engine. The air cleaner cavity is positioned within an easily accessible area of the engine, and is integrated in to the engine shroud to minimize the space around the engine which is occupied by the air cleaner assembly.

In one form thereof, the present invention provides an internal combustion engine, including an engine housing; a shroud covering at least a portion of the engine housing; a cover mounted to the shroud, the shroud and the cover cooperating to define a substantially enclosed air cleaner cavity; and an air cleaner element releasably mounted within the air cleaner cavity.

In another form thereof, the present invention provides an internal combustion engine, including an engine housing; a shroud covering at least a portion of the engine housing; a cover mounted to the shroud, the shroud and the cover cooperating to define a substantially enclosed air cleaner cavity; and an air cleaner element disposed within the air cleaner cavity; and means for releasably retaining the air cleaner element within the air cleaner cavity.

In a further form thereof, the present invention provides an internal combustion engine, including an engine housing; a carburetor attached to the engine housing; a shroud covering at least a portion of the engine housing, the shroud defining a recessed cavity therein in communication with the carburetor; a plurality of mounts within the recessed cavity; an air cleaner element disposed within the recessed cavity, the air cleaner element releasably retained by the mounts.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
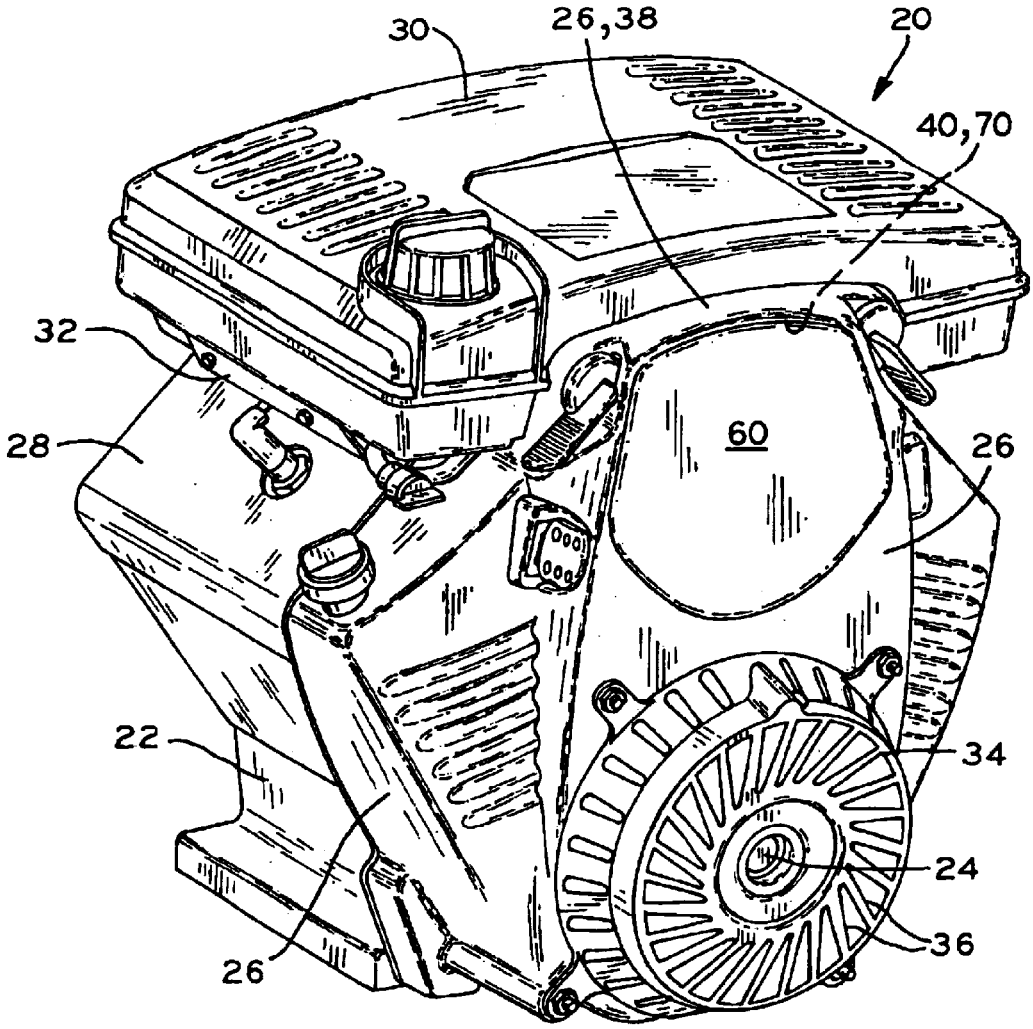
FIG. 1 is front perspective view of a horizontal crankshaft, V-twin engine including an air cleaner assembly in accordance with the present invention.

Referring first to FIG. 1, a small internal combustion engine 20 is shown as a horizontal crankshaft V-twin engine, such as that described in detail in U.S. patent application Ser. No. 10/409,262, entitled INTERNAL COMBUSTION ENGINE, filed on Apr. 8, 2003 assigned to the assignee of the present invention, the disclosure of which is expressly incorporated herein by reference. Although engine 20 is shown as a horizontal crankshaft V-twin engine, the present invention may be embodied within any small internal combustion engine, such as vertical crankshaft V-twin engines, or horizontal or vertical crankshaft single cylinder engines.

Engine 20 generally includes crankcase 22 having a pair of engine cylinders (not visible) mounted to crankcase 22 in the manner described in the above-incorporated U.S. patent application Ser. No. 10/409,262. A horizontally disposed crankshaft 24 is rotatably carried within crankcase 22, and is coupled to a pair of conventional piston/connecting rod assemblies (not shown), one corresponding to each engine cylinder.

Engine cover or shroud 26 is connected to crankcase 22 and covers at least a portion of each of crankcase 22 and the cylinders. Shroud 26 may be formed of metal, or from an injection-molded or vacuum-formed plastic material, for example. Cylinder wraps 28, typically made of a relatively thin sheet metal, are also connected to crankcase 22 and the cylinders, and closely surround the cylinders for directing cooling air around the cylinders. Fuel tank 30 is mounted via brackets 32 to the upper ends of cylinder wraps 28. Air inlet screen 34 is mounted to shroud 26, and covers an opening in shroud 26 through which intake air is drawn by rotation of the engine flywheel (not shown), which is attached to an end of crankshaft 24 which extends externally of crankcase 22. Specifically, rotation of the flywheel draws intake air through louvers 36 in screen 34 and into an area defined between crankcase 22 and shroud 26. Additional details regarding engine 20, and in particular, the control system of engine 20, are discussed in detail in U.S. patent application Ser. No. 10/409,202, entitled ENGINE CONTROL SYSTEM, filed on April 8, 2003 assigned to the assignee of the present invention, the disclosure of which is expressly incorporated herein by reference.

Figure 2:
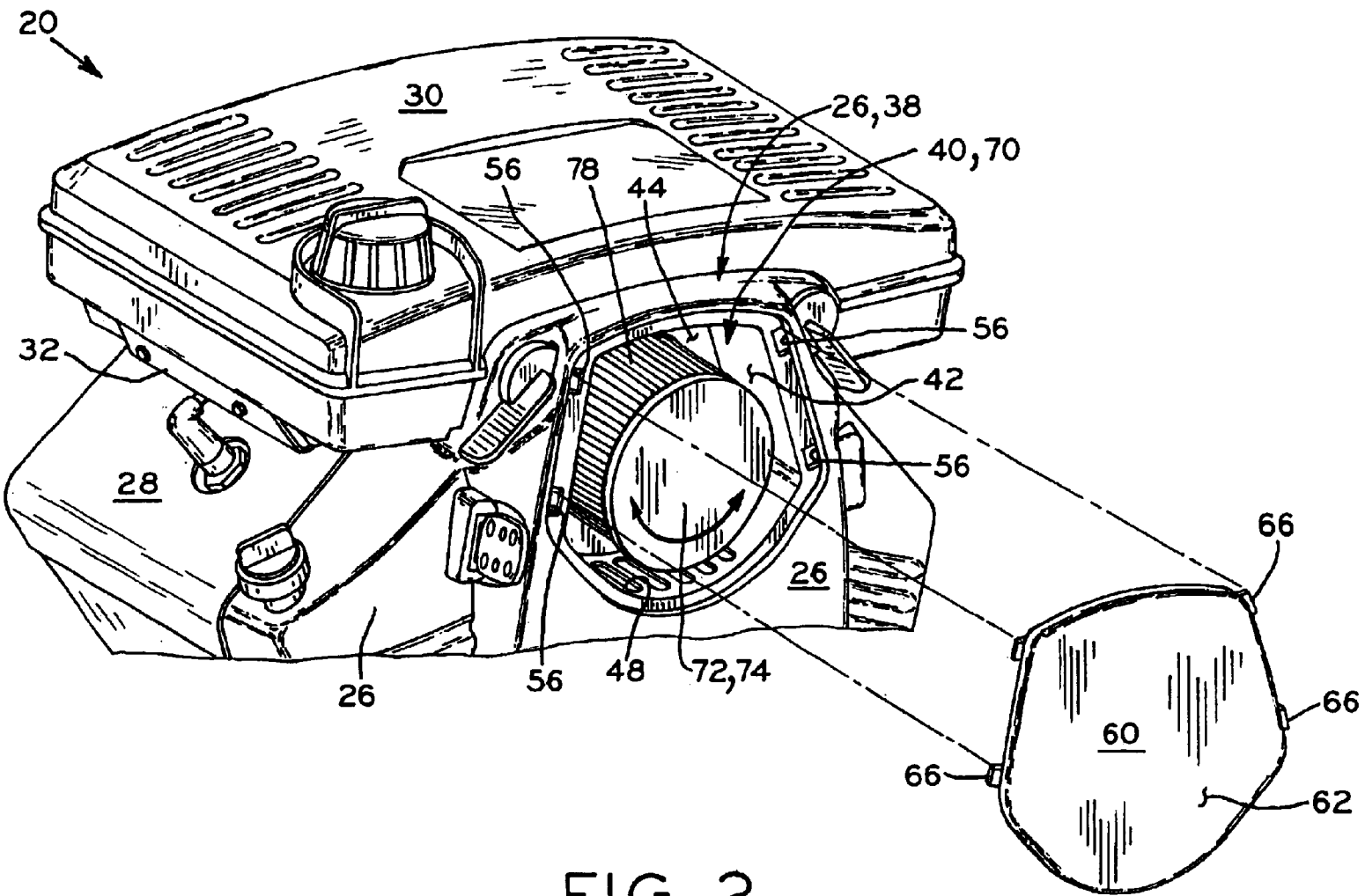
FIG. 2 is a fragmentary view of a portion of the engine of FIG. 1, showing the cover of the air cleaner assembly exploded away therefrom, the air cleaner element visible within the air cleaner cavity.
Figures 3A, 3B:
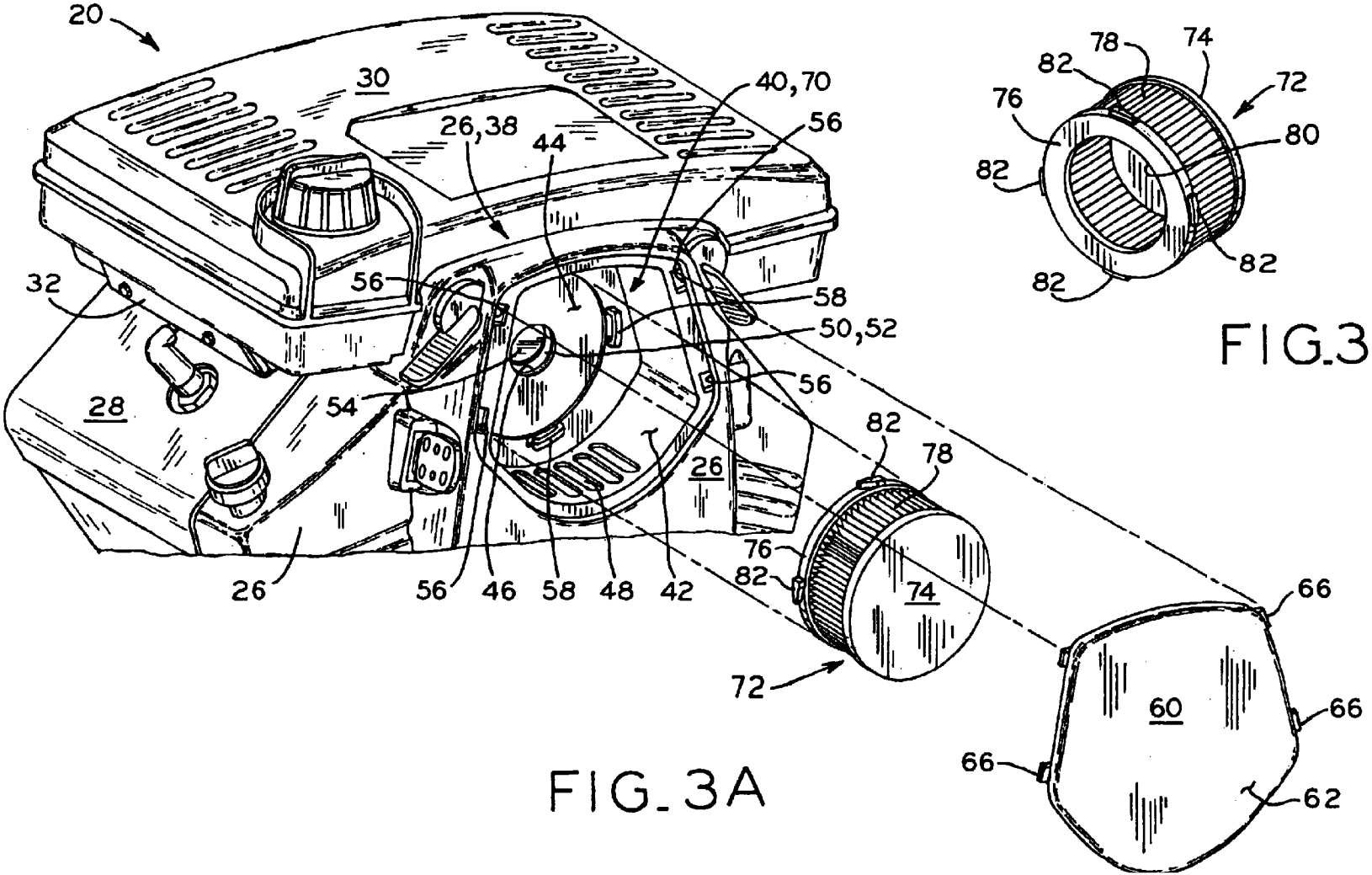
FIG. 3A is a fragmentary view of a portion of the engine of FIG. 1, showing the cover and air cleaner element exploded away from the air filter cavity to show the interior of the air filter cavity.
FIG. 3B is a perspective view of the air cleaner element of FIG. 3A.

Referring to FIGS. 2 and 3A, an upper or distal portion 38 of shroud 26, which is generally spaced upwardly or away from crankshaft 24 and faces the front side of engine 20, includes a recessed portion 40 integrally formed therewith. Recessed portion 40 of shroud generally includes side wall 42 and base wall 44 having a circular opening 46 therein. Air inlet openings 48 may be formed in side wall 42 to allow air to pass from the area between crankcase 22 and shroud 26 into the interior of recessed portion 40 of shroud 26. Base wall 44 may alternatively be formed as a separate component from the remainder of shroud 26, with base wall 44 and side wall 42 positioned in an abutting or close-fitting engagement with one another to define recessed portion 40.

Carburetor 50 is mounted to the rear surface of base wall 44 of shroud 26, and includes an intake passage or throat 52 extending therethrough. Carburetor 50 mixes fuel with air which is drawn into throat 52 to provide an air/fuel mixture for combustion within engine 20. Choke valve 54 and a throttle valve (not shown) are rotatably disposed within throat 52 to regulate the mass air/fuel intake of engine 20. In this manner, carburetor 50 and recessed portion 40 of shroud 26 are in fluid communication with one another through opening 46 in shroud 26.

Shroud 26 includes a plurality of slots 56 spaced therearound, which are shown disposed within side wall 42. Shroud 26 also includes a plurality of mounts 58 which are spaced around the periphery of base wall 44. Mounts 58, discussed in detail below, may be integrally formed with base wall 44 or with side wall 42, for example, or may be formed as separate components attached either to base wall 44 or to side wall 42.

Cover 60 may be made of a suitable flexible plastic material, for example, and includes outer surface 62 and an inner surface opposite outer surface 62, as well as a plurality of lugs 66 depending from cover 60 which releasably engage within slots 56 of shroud 26 via a releasable, snap-fit engagement to secure cover 60 to shroud 26. Cover 60 may be released from shroud 26, for example, by grasping the edges of cover 60 and flexing cover 60 to dislodge lugs 66 from slots 56, followed by removing cover 60 from shroud 26. Cover 60 covers recessed portion 40 defined within shroud 26 such that cover 60 and shroud 26 cooperate to define a substantially enclosed air cleaner cavity 70 therebetween, with air cleaner cavity 70 in communication with intake air by suitable means, and also in communication with the inlet end of carburetor 50. In this manner, air cleaner cavity 70 is defined by shroud 26 and cover 60, such that air cleaner cavity 70 is integrated into shroud 26 and does not comprise a separate component which must be attached via brackets, fasteners, etc., to the housing of engine 20, as in known air cleaner assemblies.

Air cleaner element 72 is shown in FIGS. 3A and 3B as a substantially annular air filter member; however, the shape and overall profile of air cleaner element 72 may vary. Air cleaner element 72 generally includes top plate 74, bottom plate 76, and filter media 78 captured between top plate 74 and bottom plate 76. Top plate 74 and bottom plate 76 may be formed of molded rubber or plastic, for example, and may be molded or otherwise formed about filter media 78 such that filter media 78 is integrally bonded to, and captured between, top plate 74 and bottom plate 76. Filter media 78 may be made of an air-permeable paper, which is folded in an accordion-like fashion to increase its exposed surface area. Alternatively, filter media 78 may be formed of an air-permeable foam, a sponge-like material, or a screen/mesh material.

Figure 5:
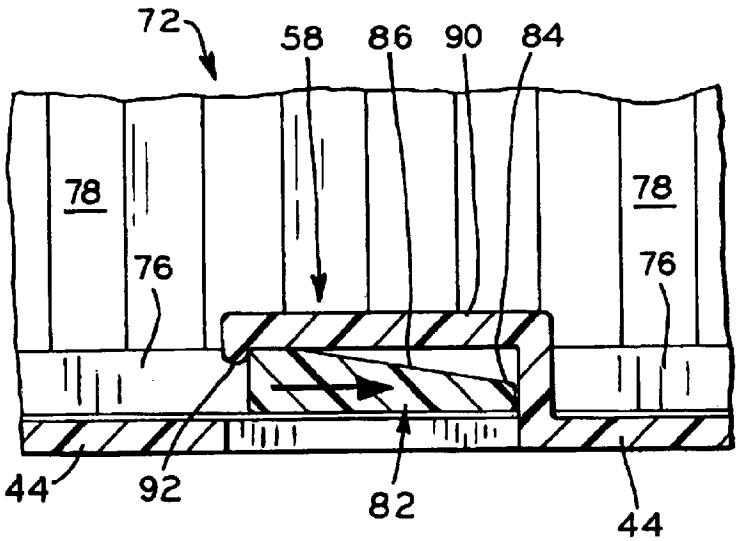
FIG. 5 is a fragmentary view showing interlocking portions of the air cleaner element and the shroud in an engaged position to releasably retain the air cleaner element within the air cleaner cavity.
Figure 4:
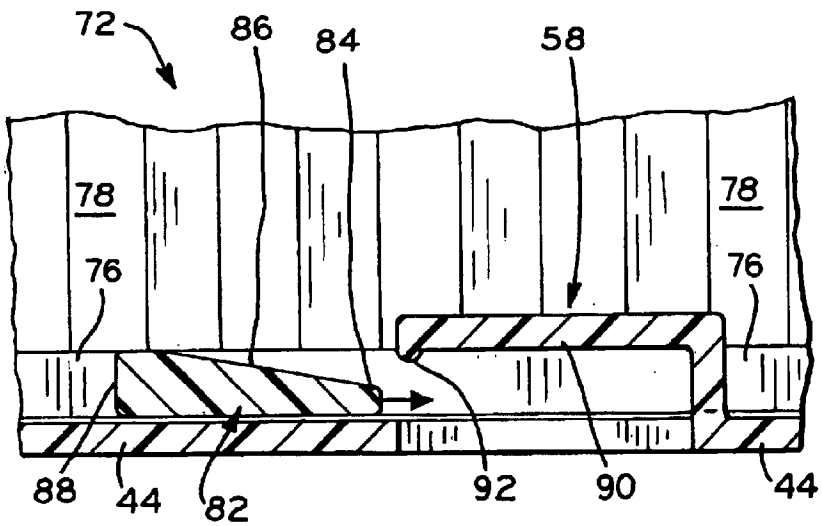
FIG. 4 is a fragmentary view showing interlocking portions of the air cleaner element and the shroud in a non-engaging position.

Bottom plate 76 includes central opening 80, shown in FIG. 3B, around which filter media 78 is radially disposed. As discussed below, central opening 80 of bottom plate 76 may be aligned with opening 46 of base wall 44 of shroud 26. Bottom plate 76 additionally includes a plurality of tabs 82 spaced therearound, which project from the outer circumference of bottom plate 76. Tabs 82 may be integrally formed with bottom plate 76, or may be separately attached to bottom plate 76. As shown in FIGS. 4 and 5, each tab 82 includes a tapered or rounded nose portion 84, ramp surface 86, and rear edge 88. Ramp surface 86 is generally inclined from nose portion 84 to rear edge 88.

Mounts 58 are integrally formed in base wall 44 of shroud 26, and include resilient fingers 90 extending parallel to base wall 44, with fingers 90 terminating in lugs 92.

To mount air cleaner element 72 within air cleaner cavity 70, air cleaner element 72 is positioned within the interior of air cleaner cavity 70, with bottom plate 76 of air cleaner element 72 in abutment with base wall 44, such that central opening 80 of bottom plate 76 is aligned concentrically about opening 46 in base wall 44, with the interior of air filter element 72 in communication with throat 52 of carburetor 50. In this position, tabs 82 of air cleaner element 72 are positioned between respective mounts 58 of base wall 44. Thereafter, air cleaner element 72 is rotated within air cleaner cavity 70 in a first direction indicated by the arrow in FIG. 2, from the position shown in FIG. 4 to the position shown in FIG. 5, such that tabs 82 and mounts 58 engage one another. Specifically, as shown in FIGS. 4 and 5, nose portions 84 of tabs 82 move beneath fingers 90 of mounts 58, and ramp surfaces 86 of tabs 82 gradually engage lugs 92 of fingers 90 to flex fingers 90 outwardly away from base wall 44. Eventually, as tabs 82 continue to pass beneath fingers 90, lugs 92 of fingers 90 will clear rear edges 88 of tabs 82, allowing fingers 90 to flex inwardly toward base wall 44 such that lugs 92 engage behind rear edges 88 of tabs 82 to thereby releasably retain air cleaner element 72 in position. Thereafter, cover 60 is attached to shroud 26 in the manner described above to substantially enclose air cleaner cavity 70.

The engagement between tabs 82 and mounts 58, described above, engages bottom plate 76 with base wall 44 to thereby form a seal between bottom plate 76 of air cleaner element 72 and base wall 44 of shroud 26, such that dirt, dust, or other particulate matter is prevented from passing between bottom plate 76 of air cleaner element 72 and base wall 44 of shroud 26 and into throat 52 of carburetor 50. Alternatively, air cleaner element 72 may include mounts 58 and shroud 26 may include tabs 82. Further, other modes for releasable attachment of air cleaner element 72 within air cleaner cavity 70 may become apparent to one of ordinary skill in the art in view of the teachings herein.

During operation of engine 20, ambient air is drawn through louvers 36 of air inlet screen 34 into the space between crankcase 22 and shroud 26 by rotation of the flywheel. A portion of this air is drawn through air inlet openings 48 in side wall 42 and into air cleaner cavity 70. Alternatively, intake air may enter air cleaner cavity 70 by another manner. For example, cover 60 may include one or more air intake openings (not shown) through which intake air may be drawn into air cleaner cavity 70 directly from the atmosphere. Alternatively, base wall 44 may include one or more of air inlet openings 48 through which intake air may enter air cleaner cavity 70.

Air within air cleaner cavity 70 then passes through filter media 78 of air cleaner element 72, through opening 46 in base wall 44, and into the intake end of carburetor 50. Filter media 78 captures any dirt, dust, or other particulate matter from the air and prevents same from entering carburetor 50.

Through use, filter media 78 may become clogged by particulate matter and may need to be removed from air cleaner cavity 70 for cleaning or replacement. To remove air cleaner element 72, cover 60 is detached from air cleaner cavity 70 to expose air cleaner cavity 70 and air cleaner element 72 therewithin. Thereafter, air cleaner element 72 may be grasped by a user, and then rotated along a second direction opposite to the above-described first direction indicated by the arrow in FIG. 2, to detach air cleaner element 72 from base wall 44 of shroud 26 in the opposite manner as described above with respect to attachment of air cleaner element 72. Specifically, when air cleaner element 72 is rotated from the position shown in FIG. 5 to the position shown in FIG. 4, rear edges 88 of tabs 82 engage lugs 92 of fingers 90 to bias same upwardly such that tabs 82 may be rotated out of engagement with fingers 90 and mounts 58. Thereafter, air cleaner element 72 may be removed from air cleaner cavity 70 for cleaning or replacement. A new air cleaner element 72 may be installed within air cleaner cavity 70 in the manner described above.

Advantageously, the releasable engagement between tabs 82 of air cleaner element 72 with mounts 58 of shroud 26 retain air cleaner element 72 in position such that bottom plate 76 of air cleaner element 72 is sealed against base wall 44 of shroud 26 to prevent dust, dirt, or other particulate matter from passing therebetween and entering into carburetor 50. Also, even through air cleaner element 72 experiences vibrations during running of engine 20, the releasable engagement between tabs 82 of air cleaner element 72 with mounts 58 of shroud 26 retain air cleaner element 72 in position. Additionally, even if cover 60 should become detached from shroud 26 during operation of engine 20, air cleaner element 72 is retained within air cleaner cavity 70 and is operable to remove dirt, dust, or other particulate matter from the intake air which passes into carburetor 50.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

an engine housing;

a shroud covering at least a portion of said engine housing, said shroud including a plurality of first attachment structures;

a cover mounted to said shroud, said shroud and said cover cooperating to define a substantially enclosed air cleaner cavity; and an air cleaner element including a plurality of second attachment structures configured for releasable attachment with respective attachment structures of said first plurality, wherein said air cleaner element is releasably mounted within said air cleaner cavity.

2. The internal combustion engine of claim 1, further comprising a carburetor attached to said engine housing, said carburetor in fluid communication with said air cleaner cavity.

3. The internal combustion engine of claim 2, wherein said shroud includes a wall having an opening, said air cleaner cavity in communication with said carburetor through said opening.

4. The internal combustion engine of claim 3, wherein said air cleaner element is positioned in abutting sealing relationship with said wall, whereby particulate materials are prevented from passing between said wall and said air cleaner element.

5. The internal combustion engine of claim 1, wherein said shroud defines a recessed portion therein, said cover covering said recessed portion to define said air cleaner cavity.

6. The internal combustion engine of claim 1, wherein said first attachment structures of said shroud include a plurality of mounts, and said second attachment structures of said air cleaner include a plurality of tabs releasably engagable with respective said mounts to releasably attach said air cleaner element to said shroud.

7. The internal combustion engine of claim 6, wherein said mounts are integrally formed with said shroud.

8. The internal combustion engine of claim 6, wherein said mounts include resilient portions releasably engagable with at least a portion of said tabs.

9. The internal combustion engine of claim 1, wherein said cover includes a plurality of tabs releasably received within apertures in said shroud to thereby releasably attach said cover to said shroud.

10. An internal combustion engine, comprising:

an engine housing;

a shroud covering at least a portion of the engine housing;

a cover mounted to said shroud, said shroud and said cover cooperating to define a substantially enclosed air cleaner cavity;

an air cleaner element disposed within said air cleaner cavity; and means for releasably retaining said air cleaner element within said air cleaner cavity, wherein said means for releasably retaining comprises a plurality of mounts integrally formed with one of said shroud and said air cleaner element and a plurality of tabs extending from the other of said shroud and said air cleaner element, said tabs and mounts releasably engagable with one another.

11. The internal combustion engine of claim 10, further comprising a carburetor attached to said engine housing, said carburetor in fluid communication with said air cleaner cavity.

12. The internal combustion engine of claim 10, wherein said shroud defines a recessed portion therein, said cover covering said recessed portion to define said air cleaner cavity.

13. The internal combustion engine of claim 10, further comprising means for sealing said air cleaner element to said shroud and preventing the passage particulate material therebetween.

14. The internal combustion engine of claim 10, further comprising means for mounting said cover to said shroud.

15. An internal combustion engine, comprising:

an engine housing;

a carburetor attached to said engine housing;

a shroud covering at least a portion of the engine housing, said shroud defining a recessed cavity therein in communication with said carburetor;

a plurality of mounts within said recessed cavity;

an air cleaner element disposed within said recessed cavity, said air cleaner element releasably retained by said mounts, wherein said air cleaner element comprises a plurality of tabs, said tabs and mounts releasably engagable with one another.

* * * * *

UNITED STATES PATENT AND TRADEMARK OFFICE

CERTIFICATE OF CORRECTION

PATENT NO. : 6,857,399 B2
DATED : February 22, 2005
INVENTOR(S) : Steven T. Davis et al.

It is certified that error appears in the above-identified patent and that said Letters Patent is hereby corrected as shown below:

Tilte page,
Item [57], ABSTRACT,
Line 7, delete "sir" and insert -- air --.

Signed and Sealed this

Seventeenth Day of May, 2005

JON W. DUDAS
*Director of the United States Patent and Trademark Office*